US006741210B2

(12) United States Patent
Brachat et al.

(10) Patent No.: US 6,741,210 B2
(45) Date of Patent: May 25, 2004

(54) DUAL BAND PRINTED ANTENNA

(75) Inventors: Patrice Brachat, Nice (FR); Jean-Pierre Blot, La Turbie (FR)

(73) Assignee: France Telecom, Paris (FR)

( * ) Notice: Subject to any disclaimer, the term of this patent is extended or adjusted under 35 U.S.C. 154(b) by 218 days.

(21) Appl. No.: 10/119,084

(22) Filed: Apr. 10, 2002

(65) Prior Publication Data

US 2002/0113737 A1 Aug. 22, 2002

Related U.S. Application Data

(63) Continuation of application No. PCT/FR00/03134, filed on Nov. 9, 2000.

(30) Foreign Application Priority Data

Nov. 12, 1999 (FR) ..... 99 14329

(51) Int. Cl.[7] ..... H01Q 1/38
(52) U.S. Cl. ..... 343/700 MS; 343/829
(58) Field of Search ..... 343/700 MS, 767, 343/770, 769, 829, 846, 848, 853

(56) References Cited

U.S. PATENT DOCUMENTS

| | | | | | |
|---|---|---|---|---|---|
| 4,847,625 | A | * | 7/1989 | Dietrich et al. | 343/700 MS |
| 5,043,738 | A | * | 8/1991 | Shapiro et al. | 343/700 MS |
| 5,124,713 | A | * | 6/1992 | Mayes et al. | 343/700 MS |
| 5,241,321 | A | * | 8/1993 | Tsao | 343/700 MS |
| 6,008,763 | A | * | 12/1999 | Nystrom et al. | 343/700 MS |
| 6,018,320 | A | * | 1/2000 | Jidhage et al. | 343/700 MS |

FOREIGN PATENT DOCUMENTS

| | | |
|---|---|---|
| EP | 0 447 218 A | 9/1991 |
| EP | 0 484 241 A | 5/1992 |

OTHER PUBLICATIONS

Brachat P et al., Dual–Polarization Slot–Coupled Printed Antennas Fed by Stripline. IEEE Transactions on Antennas and Propagation, vol. 43, No. 7, Jul. 1, 1995, pp. 738–742.
Croq F et al., Multifrequency Operation of Microstrip Antennas Using Aperture Coupled Parallel Resonators, IEEE Transactions on Antennas and Propagation, vol. 40, No. 11, Nov. 1, 1992, pp. 1367–1374.
Lakhdar Zaid et al., Dual–Frequency and Broad–Band Antennas with Stacked Quarter Wavelength Elements, IEEE Transactions on Antennas and Propagation, vol. 47, No. 4, Apr. 1999, pp. 654–660.

* cited by examiner

*Primary Examiner*—Tho Phan
(74) *Attorney, Agent, or Firm*—Lawrence E. Laubscher, Sr.

(57) ABSTRACT

The printed antenna is compact and comprises, superposed by dielectric layers, two feed lines having perpendicular microstrips, a ground plane, a first radiating element including a plurality of conductive strips perpendicular to a first coupling slot formed in the ground plane, and a second radiating element superposed on the first element and including a plurality of conductive strips crossing by superposition the first strips and perpendicular to a second coupling slot formed in the ground plane. For example, the elements radiate in the DCS-1800 and GSM radiotelephone frequency bands with perfectly orthogonal fields.

7 Claims, 3 Drawing Sheets

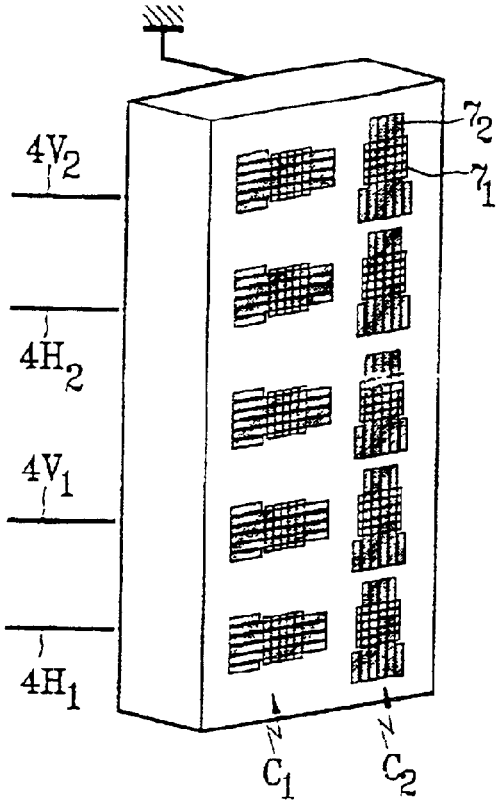
FIG. 6
FIG. 7
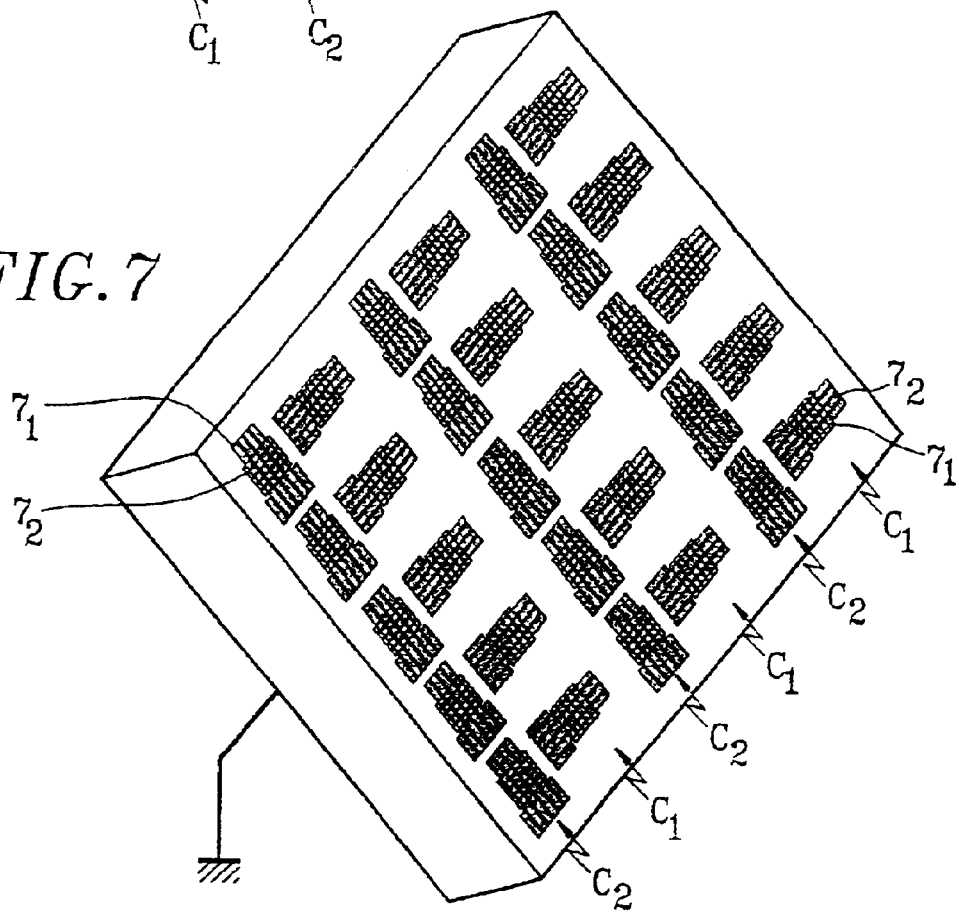

DUAL BAND PRINTED ANTENNA

REFERENCE TO RELATED APPLICATION

This application is a continuation of the PCT International Application No. PCT/FR00/03134 filed on Nov. 9, 2000, which is based on the French Application No. 99-14329 filed on Nov. 12, 1999.

BACKGROUND OF THE INVENTION

The present invention relates to an elementary circuit antenna for a network for sending and/or receiving telecommunication signals, capable of radiating polarization-duplexed radio-electrical fields, i.e. capable of operating with dual polarization, and of operating in two frequency bands.

Such an antenna is designed to operate in the first frequency band of a cellular radio telecommunications network conforming to the DCS-1800 standard and in a second band of frequencies for a cellular radio communications system conforming to the GSM-900 standard.

In the paper "Multifrequency Operation of Microstrip Antennas Using Aperture Coupled Parallel Resonators" by Frederic Croq and David M. Pozar, IEEE TRANSACTIONS ON ANTENNAS AND PROPAGATION, Vol. 40, No. 11, November 1992, pages 1367 to 1374, a microstrip antenna includes two dielectric layers with a ground conductor plane between them and a microstrip microwave feed line and a radiating element arranged on respective outside faces. The radiating element includes a plurality of parallel conductive strips of different lengths and extending perpendicularly to a coupling slot formed in the ground conductor plane. As a general rule, 2 N conductive strips are distributed symmetrically about an axis transverse to the slot and thus constitute 2 N dipoles excited symmetrically by the slot and resonating at N frequencies.

In the paper "Dual-Frequency and Broad-Band Antennas with Stacked Quarter Wavelength Elements" by Lakhdar Za ïd et al., IEEE TRANSACTIONS ON ANTENNAS AND PROPAGATION, Vol. 47, No. 4, April 1999, pages 654 to 660, a dual band antenna is formed of two stacked quarter-wave elements short-circuited along opposite lateral planes or a common lateral plane.

The antennas described in the above two papers offer bandwidths of less than 10% for a standing wave ratio less than 1.5 and for mean frequencies of the order of a few Gigahertz.

OBJECT OF THE INVENTION

An object of the present invention is to provide a printed antenna capable of operating in two frequency bands with a standing wave ratio of less than 1.5 over more than 10% of the bandwidth in each band and with electromagnetic field polarizations that are crossed in the two bands so that signals in one band do not interfere with signals in the other band.

SUMMARY OF THE INVENTION

A printed circuit antenna in accordance with the invention includes, as described in European patent No. 484,241 filed by the assignee and in the paper "Dual-Polarization Slot-Coupled Printed Antennas Fed by Stripline" by P. Brachat et al., IEEE TRANSACTIONS ON ANTENNAS AND PROPAGATION, Vol. 43, No. 7, July 1995, pages 738 to 742, a first dielectric layer, a second dielectric layer, a first microwave feed line having a first microwave strip disposed on an outside face of the first layer and a ground conductor plane disposed between the first and second layers, and a first radiating element disposed on another face of the second layer and including a plurality of first narrow conductive strips perpendicular to a first coupling slot in the conductor plane for coupling the first feed line to the first radiating element.

Based on the above single polarization printed antenna structure with single band operation, the invention provides an improvement whereby an antenna according to the invention includes a second microwave feed line constituted by a second microstrip disposed on the outside face of the first layer perpendicularly to the first microstrip and by said ground conductor plane, a third dielectric layer having a face disposed against the first radiating element, and a second radiating element disposed on another face of the third layer and including a plurality of second narrow conductive strips crossing perpendicularly by superposition the first conductive strips and extending perpendicular to a second coupling slot in the ground conductor plane for coupling the second feed line to the second radiating element.

Thanks to the second radiating element, the antenna according to the invention operates at two different frequencies with respective orthogonal polarizations. For example, the first element radiates in the frequency band of the DCS 1800 radiotelephone network and the second element radiates in the frequency band of the GSM radiotelephone network. The antenna in accordance with the invention has the same bandwidth performance as the prior art antenna described in European Patent No. 484,241 and the same polarization purity thanks to the concept of a grid formed by the first strips and the second strips to constitute the first and second radiating elements. The perpendicular arrangement of the first strips relative to the second strips avoids any interference caused by the polarized radio-electrical field emitted by the first element relative to the polarized radio-electrical field emitted by the second element.

What is more, the printed circuit antenna according to the invention is compact because the two feed lines have a common ground conductor plane including the two coupling slots and microstrips disposed on the same face of the first dielectric layer, and the strips of the radiating elements are superposed where they cross over.

The invention concerns an array of antennas including a plurality of first antennas whose first shorter strips are parallel to each other and whose second strips are also parallel to each other.

For this array of antennas to have crossed polarizations in each of the two frequency bands, it includes a plurality of second antennas whose shorter first strips and second strips extend coplanar and respectively perpendicular to the first strips and to the second strips of the first antennas.

The first antennas are divided into columns which are interleaved two by two with columns into which the second antennas are divided.

BRIEF DESCRIPTION OF THE DRAWINGS

Other features and advantages of the present invention will become more clearly apparent on reading the following description of preferred embodiments of the invention, which description is given with reference to the corresponding accompanying drawings, in which:

FIG. 6 is a diagrammatic perspective view of a one-dimensional array with two columns of elementary printed antennas in accordance with the invention for crossed radiated fields in each of two frequency bands; and FIG. 7 is a diagrammatic perspective view of a two-dimensional array with elementary printed antennas according to the invention.

DESCRIPTION OF THE PREFERRED EMBODIMENTS

The following description of an elementary dual band printed antenna according to a preferred embodiment of the invention, illustrated virtually full size in FIGS. 1 to 5, provides numerical values by way of example for an antenna designed to operate in a first frequency band $B_1$, referred to as the upper band, from 1 710 MHz to 1 880 MHz, corresponding to radiotelephone communications conforming to the DCS-1800 standard, and in a second band $B_2$, referred to as the lower band, from 890 MHz to 960 MHz, for radiotelephone communications conforming to the GSM standard.

Figure 2:
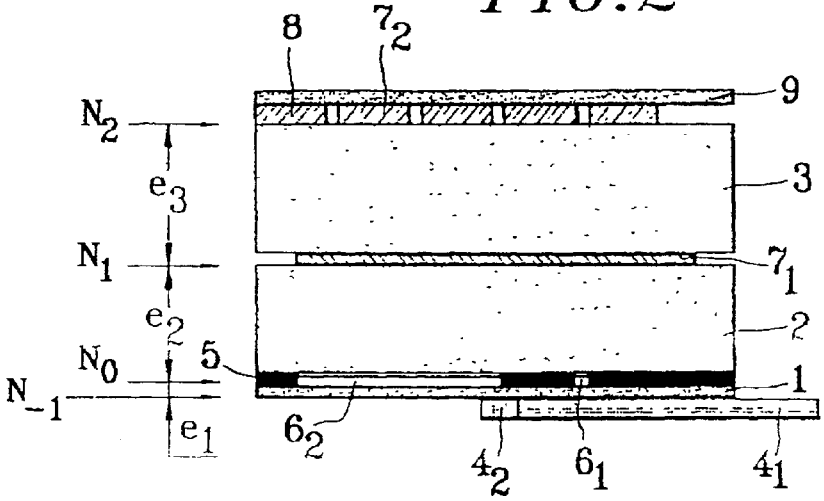
FIG. 2 is a view of the dual band antenna in section taken along the broken line II—II in FIG. 1.
Figure 1:
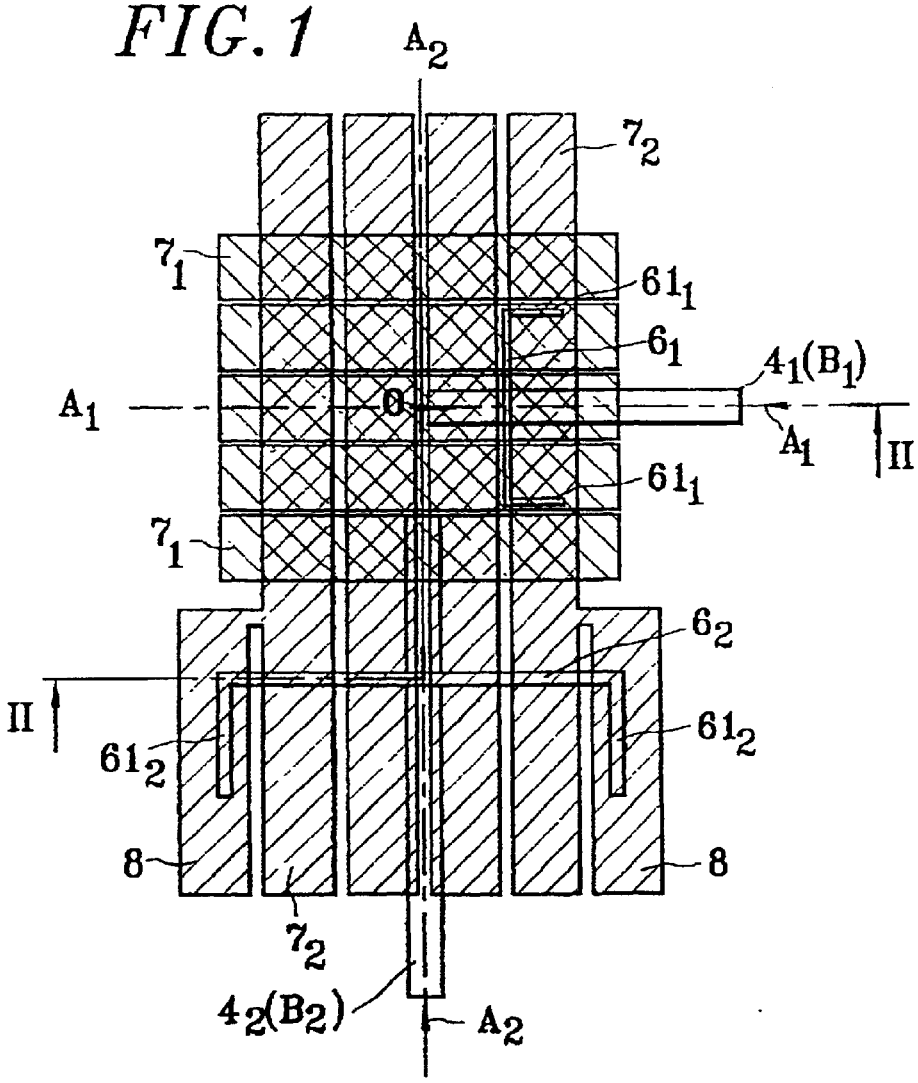
FIG. 1 is a plan view of one embodiment of a dual band printed circuit antenna according to the invention.
Figure 3:
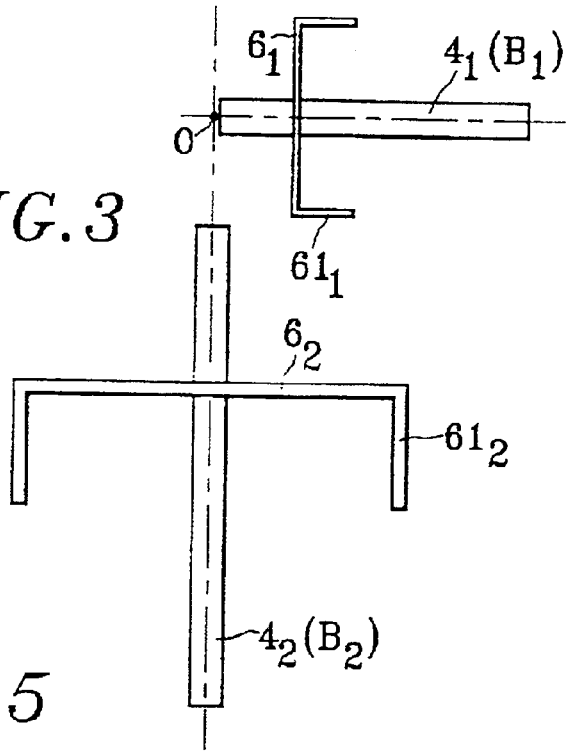
FIG. 3 is a plan view at the levels of feed lines and a ground plane with coupling slots in the dual band antenna shown in FIGS. 1 and 2.
Figure 5:
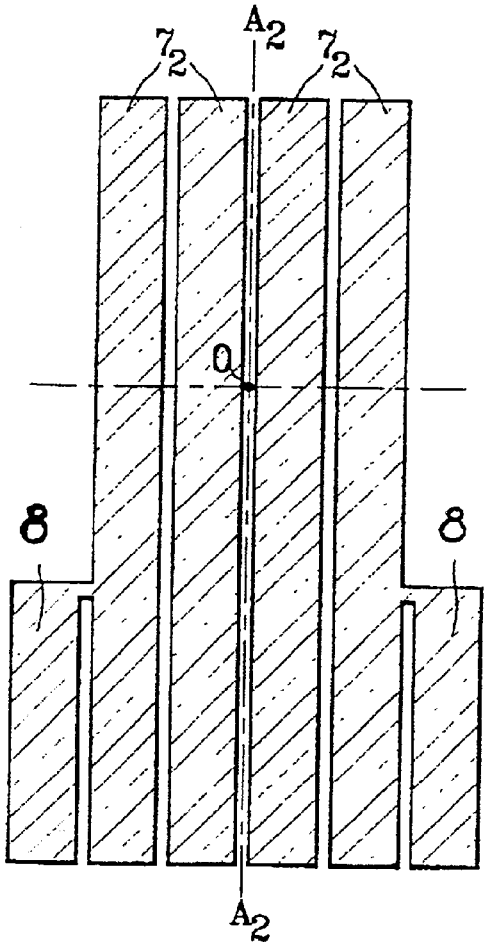
FIG. 5 is a plan view of a larger second radiating element associated with a lower frequency band and included in the dual band antenna shown in FIGS. 1 and 2.
Figure 4:
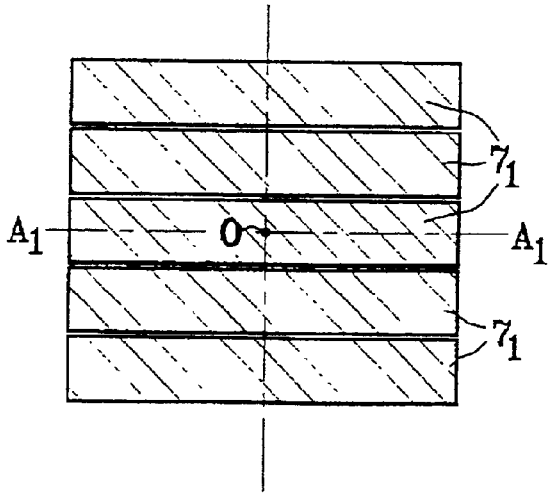
FIG. 4 is a plan view of a smaller first radiating element associated with a higher frequency band and included in the dual band antenna shown in FIGS. 1 and 2.

As shown in FIG. 2, the dual band antenna has three stacked dielectric layers: a Duroid first layer 1 having a relative dielectric permittivity $\in r_1=2.2$ and a thickness $e_1=1.5$ mm, a second layer 2 made from dielectric foam having a relative dielectric permittivity $\in r_2=1.05$ and a thickness $e_2=15$ mm, and a third layer made in dielectric foam having a relative dielectric permittivity $\in r_3=1.05$ and a thickness $e_3=20$ mm. The antenna has four stacked levels of electrical conductors $N_{-1}$ to $N_2$ separated by the three dielectric layers, as shown by stracking in FIG. 1. The level $N_{-1}$ on the bottom face of the antenna, i.e. on the outside face of the first dielectric layer 1, includes two perpendicular microstrips $\mathbf{4}_1$ and $\mathbf{4}_2$ for the respective microwave feed lines in the frequency bands $B_1$ (upper band) and $B_2$ (lower band). The microstrips $\mathbf{4}_1$ and $\mathbf{4}_2$ can extend as far as a "crossover" point O of the perpendicular longitudinal axes of symmetry $A_1A_1$ and $A_2A_2$ of the radiating elements $\mathbf{7}_1$ and $\mathbf{7}_2$. As shown in FIG. 3, the level $N_0$ between the first and second dielectric layers 1 and 2 includes a ground conductor plane 5 in which are formed a first coupling slot $\mathbf{6}_1$ extending perpendicular to the first microstrip $\mathbf{4}_1$ and symmetrical with respect to the latter and a second coupling slot $\mathbf{6}_2$ extending perpendicular to the second microstrip $\mathbf{4}_2$ and symmetrical with respect to the latter. The first slot $\mathbf{6}_1$ is 28.7 mm long and shorter than the second slot $\mathbf{6}_2$ which is 59 mm long. The microstrips $\mathbf{4}_1$ and $\mathbf{4}_2$ extend beyond the respective coupling slots $\mathbf{6}_1$ and $\mathbf{6}_2$ over substantially less than a quarter of the respective wavelength. The third level $N_1$ also shown in FIG. 4 includes a striated first radiating element made up of five parallel narrow metal strips $\mathbf{7}_1$ extending perpendicular to and on top of the first slot $\mathbf{6}_1$, to which they are coupled, without covering the second slot $\mathbf{6}_2$, and symmetrically and equally distributed with respect to an axial plane of symmetry $A_1A_1$ longitudinal to the first microstrip $\mathbf{4}_1$. The fourth level $N_2$ also shown in FIG. 5 includes a striated second radiating element made up of four parallel narrow metal strips $\mathbf{7}_2$ extending perpendicular to and on top of the second slot $\mathbf{6}_2$, to which they are coupled, crossing the strips $\mathbf{7}_1$ on top of them, and symmetrically and equally distributed with respect to an axial plane of symmetry $A_2A_2$ longitudinal to the second microstrip $\mathbf{4}_2$. The second strips $\mathbf{7}_2$ are therefore perpendicular to the first strips $\mathbf{7}_1$.

A thin dielectric fourth layer 9 covers the metal strips $\mathbf{7}_2$ on top of the third dielectric layer 3 to provide a protective cover for the antenna.

The printed antenna according to the invention therefore combines in a compact manner two sub-antennas respectively operating in the frequency bands $B_1$ and $B_2$. The printed antenna typically extends over a maximum length of 130 mm along the longitudinal axis of the metal strips $\mathbf{7}_2$ and over a maximum width of 80 mm along the longitudinal axis of the metal strips $\mathbf{7}_1$.

The first sub-antenna consists of the microstrip feed line $\mathbf{4}_1$ matched to an impedance of 50 Ω, the coupling slot $\mathbf{6}_1$ and the radiating element metal strips $\mathbf{7}_1$. This first sub-antenna operates in the higher frequency band $B_1$ and with a polarization of the electrical field radiated by the first sub-antenna parallel to the metal strips $\mathbf{7}_1$, i.e. perpendicular to the coupling slot $\mathbf{6}_1$. The five strips $\mathbf{7}_1$ are typically inscribed in a rectangle 58 mm long by 50 mm wide spaced in pairs at 0.75 mm.

The second printed sub-antenna consists of the microstrip feed line $\mathbf{4}_2$ matched to an impedance of 50 Ω, the slot $\mathbf{6}_2$ and the radiating element metal strips $\mathbf{7}_2$. The second sub-antenna operates in the lower band $B_2$ and with a polarization of the electric field parallel to the metal strips $\mathbf{7}_2$, i.e. perpendicular to the coupling slot $\mathbf{6}_2$, and thus perfectly perpendicular to the polarized electrical field produced by the first sub-antenna. Thus the radio-electrical field in the second strip $B_2$ produced by the second sub-antenna is perfectly orthogonal to the radio-electrical field in the strip $B_1$ produced by the first sub-antenna, which avoids mutual interference of the radio-electrical fields between the bands. The metal strips $\mathbf{7}_2$ of the second sub-antenna are spaced by a thickness $e_2+e_3$ relative to the ground conductor plane 5 greater than the thickness $e_2$ between the metal strip $\mathbf{7}_1$ of the first sub-antenna relative to the ground conductor plane 5, because the second sub-antenna radiates in a frequency band $B_2$ lower than the frequency band $B_1$ of the first sub-antenna. Likewise, the coupling slot dimensions being substantially inversely proportional to the center frequency of the frequency band, the dimensions of the first coupling slot $\mathbf{6}_1$ are respectively smaller than the dimensions of the second coupling slot $\mathbf{6}_2$. Typically, each strip $B_2$ is 114 mm long and 10 mm wide and is at a distance of 2 mm from another strip.

In practice, the microstrips, ground plane and metal strips in the levels $N_{-1}$ to $N_2$ are etched on the faces of the respective dielectric layers.

In particular, the coupling slots $\mathbf{6}_1$ and $\mathbf{6}_2$ is U-shaped and respectively symmetrical to the longitudinal axes of the microstrips $\mathbf{4}_1$ and $\mathbf{4}_2$, and thus have each two lateral branches $\mathbf{61}_1$, $\mathbf{61}_2$ parallel to the conductive strips of the respective radiating element $\mathbf{7}_1$, $\mathbf{7}_2$ and having respective lengths of 9 mm and 18.2 mm, as shown in FIG. 3. This helps to reduce the overall size of the microstrip radiating elements $\mathbf{7}_1$, $\mathbf{7}_2$ and to limit the radiation therefrom in the ground plane 5, at the same time guaranteeing a relatively wide frequency band $B_1$, $B_2$.

The strips $\mathbf{7}_1$ do not cover the second slot $\mathbf{6}_2$ as this would short-circuit the second radiating element operating in the lower frequency band $B_2$. The strips $\mathbf{7}_2$ do not totally cover the striated strips $7_1$, in particular at their longitudinal ends, as this would short-circuit the first radiating element radiating in the upper band $B_1$. This imposes a very severe constraint on the width of the strips $7_2$, which is normally imposed by the size of the coupling slot $6_2$. That size is of the order of one half-wavelength. For the slots to be as short as possible, the coupling slots are angled.

The two farthest away conductor strips in the second radiating element $7_2$ are doubled along a portion of their length that is not covered by the strip $7_1$ by two supplementary lateral strips 8 superposed on the respective lateral branches $61_2$ of the second coupling slot $6_2$. This disposition of the lateral strips 8 also helps to widen the frequency band $B_2$ and to ensure correct coupling between the line $4_2$ and the radiating element $7_2$ for the frequency band $B_2$.

Measurements have shown that the printed antenna in accordance with the invention described above offered a standing wave ratio less than 1.5 over more than 10% of the bandwidth in each of the two bands $B_1$ and $B_2$, a decoupling between the polarized fields radiated in the two bands of the order of at least −30 dB, thanks in particular to the spatial filtering introduced by the two polarization grids formed by the metal strips $7_1$ and $7_2$, and radiation diagrams that are substantially symmetrical in respective principal planes perpendicular to the planes of the grids of metal strips $7_1$ and $7_2$ and passing through their axes of symmetry $A_1A_1$ and $A_2A_2$.

The radio-electrical performances of the printed antenna described above are preserved if a plurality of elementary printed antennas in accordance with the invention are juxtaposed to form a dual polarization array for each of the operating frequency bands $B_1$ and $B_2$. The feed lines, such as the lines $4_1$ and $4_2$, are advantageously disposed opposite the radiating elements consisting of the grids of metal strips $7_1$ and $7_2$ relative to the ground plane 5 to prevent mutual interference between signals transmitted in the bands $B_1$ and $B_2$.

A first embodiment of an antenna array includes a column $C_1$ of first printed circuit antennas oriented in the same fashion and a column $C_2$ of second antennas oriented in the same fashion and perpendicularly to the orientation of the first antennas, or more generally columns $C_1$ and $C_2$ which alternate and whose etching levels $N_{-1}$, to $N_2$ are common, as shown in FIG. 6. In the first column $C_1$, the first strips $7_1$ of the first antennas are disposed vertically to radiate a vertically polarized electrical field and are therefore fed by a common microstrip feed line $4V_1$, and the second strips $7_2$ of the first antennas are disposed horizontally to radiate a horizontally polarized electrical field and are fed by a microstrip common feed line $4H_1$. Symmetrically, in the second column $C_2$, the first strips $7_1$ of the second antennas are disposed horizontally and are fed by a common microstrip feed line $4H_2$ in order to radiate a horizontally polarized electrical field which is therefore crossed perpendicularly with the electrical field radiated by the strips $7_1$ in the first column $C_1$ for operation in the common first frequency band $B_1$; likewise, in the second column $C_2$, the second strips $7_2$ of the second antennas are disposed perpendicularly to the second strips $7_2$ included in the first column $C_1$ so as to radiate a vertically polarized electrical field crossed perpendicularly with the electrical field radiated by the strips $7_2$ in the first column $C_1$ for operation in the common second frequency band $B_2$, the strips $7_2$ in the column $C_2$ being fed by a common microstrip feed line $4V_2$. Each microstrip feed line feeding the respective antennas has a tree-like structure and constitutes a power distributor at each node.

This first type of array, shown in FIG. 6, can constitute an antenna for a dual polarization and dual band base station for the GSM and DCS radiotelephone networks. As a function of the orientation of the antenna, the latter has directional diagrams in elevation and broad diagrams in azimuth for two orthogonal polarizations, respectively horizontal and vertical polarizations or polarizations at −45° and +45° to the horizontal.

As shown in FIG. 7, a dual polarization and dual frequency band array of antennas can include a plurality of parallel columns $C_1$ and $C_2$ alternating in a plane. A two-dimensional array of antennas of this kind can constitute an antenna for a ground receiver station in a cellular radiocommunication system using a constellation of geostationary or non-geostationary satellites, for example.

Although the invention is described with reference to microstrip feed lines, the person skilled in the art will know how to replace them with striplines or coaxial lines. For a stripline, a supplementary dielectric layer is provided against the bottom face of the first dielectric layer 1, under the etching level $N_{-1}$, with reference to FIG. 2, and a reflector ground conductor plane is printed on the bottom face of the supplementary dielectric layer.

What we claim is:

1. A printed antenna comprising:

(a) a first dielectric layer;

(b) a second dielectric layer;

(c) a first microwave feed line having a first microwave strip disposed on an outside face of said first layer and having a ground conductor plane disposed between said first layer and second layer;

(d) a first radiating element disposed on another face of said second layer and including a plurality of first narrow conductive strips perpendicular to a first coupling slot in said ground conductor plane for coupling said first feed line to said first radiating element;

(e) a second microwave feed line constituted by a second microstrip disposed on said outside face of said first layer perpendicularly to said first microstrip and by said ground conductor plane;

(f) a third dielectric layer having a face disposed against said first radiating element; and (g) a second radiating element disposed on another face of said third layer and including a plurality of second narrow conductive strips crossing perpendicularly by superposition said first conductive strips ground conductor plane for coupling said second feed line to said second radiating element.

2. An antenna according to claim 1, wherein said second radiating element radiates in a second frequency band lower than a first frequency band in which said first radiating element radiates, and the dimensions of said first coupling slot are respectively smaller than the dimensions of said second coupling slot.

3. An antenna according to claim 1, wherein at least one of said coupling slots has a U-shape with lateral branches parallel to the conductive strips of the respective radiating element.

4. An antenna according to claim 1, wherein said second coupling slot has a U-shape with lateral branches parallel to the conductive strips of the second radiating element, and two strips farthest apart in said second radiating element have lateral strips respectively superposed on said lateral branches of the second coupling slot.

5. An array of antennas including a plurality of first printed antennas, each first printed antenna comprising:

(a) a first dielectric layer;

(b) a second dielectric layer;

(c) a first microwave feed line having a first microwave strip disposed on an outside face of said first layer and having a ground conductor plane disposed between said first layer and second layer;

(d) a first radiating element disposed on another free of said second layer and including a plurality of first narrow conductive strips perpendicular to a first coupling slot in said ground conductor plane for coupling said first feed line to said first radiating element (e) a second microwave feed line constituted by a second microstrip disposed on said outside face of said first layer perpendicularly to said first microstrip and by said ground conductor plane;

(f) a third dielectric layer having a face disposed against said first radiating element; and (g) a second radiating element disposed on another face of said third layer and including a plurality of second narrow conductive strips crossing perpendicularly by superposition first conductive strips and extending perpendicular to a second coupling slot in said ground conductor plane for coupling said second feed line to said second radiating element;

(h) said first conductive strips being shorter than said second conductive strips and parallel to each other, and said second conductive strips being also parallel to each other.

6. An antenna array according to claim 5, comprising a plurality of second printed antennas analogous to said first printed antennas and having first conductive strips shorter than the second conductive strips of said second antennas, and said first conductive strips and second conductive strips of said second antennas extending coplanar and respectively perpendicular to said first conductive strips and to said second conductive strips of said first antennas.

7. An antenna array according to claim 6, wherein said first antennas are divided into columns which are interleaved two by two with columns into which said second antennas are divided.

* * * * *